US008112975B1

(12) United States Patent
Flores et al.

(10) Patent No.: US 8,112,975 B1
(45) Date of Patent: Feb. 14, 2012

(54) SADDLE HORN COVER APPARATUS

(76) Inventors: Azam Flores, Walnut, CA (US); Catarino Gonzalez, Norco, CA (US)

( * ) Notice: Subject to any disclaimer, the term of this patent is extended or adjusted under 35 U.S.C. 154(b) by 379 days.

(21) Appl. No.: 12/408,083

(22) Filed: Mar. 20, 2009

(51) Int. Cl.
*B68B 1/02* (2006.01)

(52) U.S. Cl. ..... 54/44.1

(58) Field of Classification Search ..... 54/44.5, 54/135, 37.1, 38.1, 41.1, 42.1, 43.1, 44.1, 54/44.6, 65, 66, 67, 68; D30/134, 135; *B68C 1/02, B68C 0/12, 1/16; B68B 3/00*
See application file for complete search history.

(56) References Cited

U.S. PATENT DOCUMENTS

| | | | | | |
|---|---|---|---|---|---|
| 279,438 | A * | 6/1883 | Rubarts | 54/44.1 |
| 0,426,934 | A | 4/1890 | Heffernan | |
| 0,515,239 | A | 2/1894 | Leupold | |
| 1,106,648 | A | 8/1914 | Graves | |
| 3,388,530 | A * | 6/1968 | Parker | 54/44.1 |
| 3,707,827 | A * | 1/1973 | Strang | 54/44.1 |
| 3,835,621 | A * | 9/1974 | Gorenschek | 54/44.7 |
| 4,265,075 | A * | 5/1981 | Motsenbocker | 54/44.5 |
| 4,362,003 | A * | 12/1982 | Robinson | 54/44.1 |
| 5,179,821 | A * | 1/1993 | Hiser | 54/44.1 |
| 5,284,005 | A * | 2/1994 | Jacobi | 54/44.2 |
| 6,035,616 | A * | 3/2000 | Pickett | 54/44.5 |
| 6,062,006 | A * | 5/2000 | Jones | 54/44.7 |
| 6,775,965 | B2 | 8/2004 | Yarbrough | |
| 6,901,617 | B2 * | 6/2005 | Sprouse et al. | 5/654 |

FOREIGN PATENT DOCUMENTS

| | | |
|---|---|---|
| GB | 2050136 | 1/1981 |
| GB | 2418125 | 9/2006 |

* cited by examiner

*Primary Examiner* — Rob Swiatek
*Assistant Examiner* — Thien Thanh Pham
(74) *Attorney, Agent, or Firm* — Mind Law Firm; Justin G. Sanders; Jeromye V. Sartain

(57) ABSTRACT

A saddle horn cover apparatus is disclosed comprising, in one embodiment, a cover sized for engagement on a saddle horn and a padding configured for being received within the cover in a position between the saddle horn and an inner surface of the cover. Thus, with the apparatus so engaged on a saddle horn, the apparatus provides padding to protect the user from injuring their hands while performing various horseback riding activities.

17 Claims, 4 Drawing Sheets

SADDLE HORN COVER APPARATUS

RELATED APPLICATIONS

Not applicable.

INCORPORATION BY REFERENCE

Applicant(s) hereby incorporate herein by reference any and all U.S. patents and U.S. patent applications cited or referred to in this application.

BACKGROUND OF THE INVENTION

1. Field of the Invention

Aspects of this invention relate generally to saddle horn covers, and more particularly to a saddle horn cover apparatus configured for engagement on a saddle horn to provide padding thereon while a user is performing various horseback riding activities.

2. Description of Related Art

By way of general background, over the years, many different sporting-type activities have developed in the context of horseback riding. One such horseback riding activity is called team roping, also known as heading and heeling. Team roping is a rodeo event that features a steer and two mounted cowboys or cowgirls. The first roper is referred to as the "header," who ropes the front of the steer, usually around the horns; the second is the "heeler," who ropes the steer by its hind feet. Team roping is the only rodeo event where men and women compete equally together, in either single gender or mixed gender teams. Cowboys originally developed this technique on working ranches when it was necessary to capture and restrain a full-grown animal. The header must rope the steer with one of three legal catches: clean horn catch (around both horns), a neck catch (around the neck) or a half-head catch (around the neck and one horn). The header then takes a dally, which means a couple of wraps of the rope around the neck of the saddle horn. Speed is important and some have lost fingers in this event. Once the header has made the dally, he will turn his horse, usually to the left, and the steer will follow, still running. The heeler waits until the header has turned the steer. When he or she has a clear way, he throws a loop of rope under the running steer's hind legs and catches them. As soon as the heeler also dallies tight, the header turns his horse to directly face the steer and heeler. Both horses back up slightly to stretch out the steer's hind legs, immobilizing the animal. As soon as the steer is stretched out, an official waves a flag and the time is taken. The steer is then released and trots off. A successful professional-level team takes between four and twelve seconds to stretch the steer, depending on the length of the arena. At lower levels, a team may take longer, particularly if the heeler misses the first throw and has to try again. Because speed is such an important factor in this sport, every movement by the header and heeler is critical and, thus, performed as fast as possible. Because of this, the header and heeler frequently hit their hands on the head of the saddle horn as they attempt dally their ropes as quickly as possible. Saddles, including the saddle horn, are typically made of a hard underlying material, such as wood or fiberglass, and then covered with rawhide and/or leather. Thus, hitting one's hand on a hard saddle horn in team roping or other horseback riding activities can cause serious hand injuries, specifically to the metacarpal bones.

The following art defines the present state of this field:

U.S. Pat. No. 426,934 to Heffernan discloses a removable cover for riding saddles composed of a foldable water-proof fabric having a seat portion adapted to cover the seat of the saddle, and provided with a pocket at one edge to engage the end of the saddle, a strap at the opposite edge of the seat portion, side flaps depending from the side edges of the seat portion, and securing straps and hooks around the edges of the side flaps.

U.S. Pat. No. 515,239 to Leupold discloses an attachment for side saddles by the use of which the rider's skirt will be effectually prevented from catching on the pommel during the act of dismounting or when thrown. The attachment consists of an elastic strap provided at one end with means for fastening it to the saddle, at the opposite end with loops to secure it to the lower pommel and at an intermediate point with a pocket adapted to be secured to the upper pommel.

U.S. Pat. No. 1,106,648 to Graves discloses a front rigging for swell fork riding saddles comprising a strap with a mid-portion and two sets of two elongated strap members each, said sets extending oppositely from opposite ends of the mid-portion, and the strap members at their free ends being formed into ring engaging loops, each set of strap members being longer than the mid-portion and arranged in embracing relation to the respective swells of the swell fork.

U.S. Pat. No. 3,388,530 to Parker discloses a roping saddle horn assembly adapted to be mounted upon a saddle tree comprising an inner core having a polygonal shape in cross-section, means for connecting one end of said inner core to a saddle tree, a head detachably connected to the other end of said inner core, and an outer removable rubber tubular sleeve of similar polygonal shape in cross-section constituting a friction generating material surrounding said inner core and extending from beneath said head to said connecting means.

U.S. Pat. No. 3,707,827 to Strang discloses a strip of rubber having strap extensions at each end which are wrapped around the horn of a western saddle to increase the friction thereof, and the strap ends are secured together by the Conway buckle, and the excess strap ends are cut after the wrap is completed. The rubber thereby increases the friction and a lariat rope is wound around the wrap in roping cattle in the usual way, but requires a less number of turns of the rope around the rubber-wrapped saddle horn.

G.B. Patent No. 2,050,136 to Smith discloses a saddle cover comprising a functional surface for contacting a rider's legs, the surface having little friction against human skin and a backing anti-slip surface for contacting the saddle.

U.S. Pat. No. 4,265,075 to Motsenbocker discloses an improved saddle comprising a saddle tree which is padded and upholstered on its top. The saddle tree is attached to a padded and flexible saddle skirt by connecting flaps which are affixed to the top of the skirt and which overlie marginal portions of the upholstered tree. Screws or other fasteners are employed to connect the flaps to the upholstered tree. Preferably four flaps are provided, one at each corner of the tree. Cinch rings are mounted on the forward pair of flaps. A stirrup strap is passed through slots in the tree about the middle thereof.

U.S. Pat. No. 5,179,821 to Hiser discloses a protective cover for use with a riding saddle comprising a flexible central panel having side panels depending from its respective opposite sides for enclosing the stirrup leathers of the riding saddle. The flexible central panel has a sleeve attached to a front portion for receiving a saddle horn. According to this arrangement, the cover adjusted about the saddle by a drawstring inserted therethrough a casing defined by a folded edge of the flexible central panel, which permits the protective cover to be fitted onto riding saddles of different sizes. In order to maintain a snug fit of the flexible central panel to the riding saddle, the flexible central panel also includes elastic webbing, allowing the protective cover to conform to the complex curvature of the saddle.

U.S. Pat. No. 6,062,006 to Jones discloses a rubber fitting for installation on the saddle horn of a conventional saddle, to enhance friction with the rope during the cattle roping process, and to remain securely attached to the horn as long as needed, being a one piece hollow cylindrical fitting in the form of a sleeve of molded rubber of a type which will produce good friction with the rope wrapped thereon, with an inner diameter sufficiently undersized in relation to the saddle horn that it achieves a tight, tensioned fit over the saddle horn, though large enough that it can be stretched to be installed over the saddle horn after soap lubrication of the saddle horn and the interior of the fitting; having alternate forms for differing pommel and forks of various saddle and horn geometries of different conventional saddles, with suitable angling of the top and bottom edges of the fitting for achieving optimum fit with the pommel, fork and saddle horn geometry of each saddle model, so that the bottom of the fitting, when installed, will fit flush against the saddle's pommel and fork, so that the rope may not work under the bottom edge of the fitting; and so that the forward edge of the top of the fitting will fit beneath the forwardly projecting cap at the top of the saddle horn, so as to further resist forces tending to lift the fitting off the saddle horn.

U.S. Pat. No. 6,775,965 to Yarbrough discloses a quick release designed as a safety tool for heelers participating in the sport of team roping. During the history of team roping numerous heelers have cut off fingers and hands, when wrapping the rope around the horn of their saddle in an effort to pull the rope tight around the steer's hind legs. This quick release was designed to eliminate the dally (wrapping the rope around the horn) process. The quick release strap is wrapped around the saddle horn and buckled into place. The end of the rope is placed in the loop of the quick release. After the steer is roped, the heeler pulls on the release and the rope is freed, thus eliminating any chance of fingers or hands being caught between the rope and the horn. For added safety, the rope can be released whether it is tight or loose.

G.B. Patent No. 2,418,125 to Ratcliffe discloses a waterproof cover for a riding saddle having pouches on its underside to receive the saddle flaps and oblong openings through which the stirrup leathers and irons can be passed, the openings being protected by waterproof flaps. The cover is made in two parts joined to provide a substantially saddle-shaped cover and is held in position over the saddle by a tensioning cord which passes through tabs spaced around the periphery of the underside of the cover.

The prior art described above teaches various types of saddles, protective covers for saddles, and friction-enhancing attachments configured for engagement with the neck of a saddle horn. However, the prior art fails to teach a saddle horn cover apparatus configured for engagement with a saddle horn in order to provide padding over that portion of the saddle while a user is performing various horseback riding activities. Aspects of the present invention fulfill these needs and provide further related advantages as described in the following summary.

SUMMARY OF THE INVENTION

Aspects of the present invention teach certain benefits in construction and use which give rise to the exemplary advantages described below.

The present invention solves the above described problems by disclosing a saddle horn cover apparatus for providing padding over at least a portion of a saddle horn. In one embodiment, the apparatus comprises a cover sized for engagement on the saddle horn. A padding is configured for being received within the cover in a position between the saddle horn and an inner surface of the cover. Thus, with the apparatus so engaged on a saddle horn, the apparatus provides padding to protect the user from injuring their hands while performing various horseback riding activities, such as team roping. It should be noted that while team roping is used as an exemplary horseback riding activity, the present invention is not so limited, and can be used in conjunction with a wide range of horseback riding activities now known or later developed. Additionally, because nearly every saddle horn has relatively the same geometric shape and dimensions, the present invention can be used nearly universally on any saddle horn. Thus, in its exemplary embodiment, the saddle horn cover apparatus is a one-size-fits-all device, though certainly custom-fitting saddle horn covers may be practiced according to aspects of the present invention without departing from its spirit and scope.

A primary objective inherent in the above described apparatus is to provide advantages not taught by the prior art.

Another objective is to provide such an apparatus that is capable of providing padding over at least a portion of a saddle horn.

A further objective is to provide such an apparatus that is capable of removable engagement on a wide range of saddle horns.

A still further objective is to provide such an apparatus that provides a cover configured for selectively receiving a padding.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

DETAILED DESCRIPTION OF THE INVENTION

The above described drawing figures illustrate aspects of the invention in at least one of its exemplary embodiments, which are further defined in detail in the following description.

Figure 1:
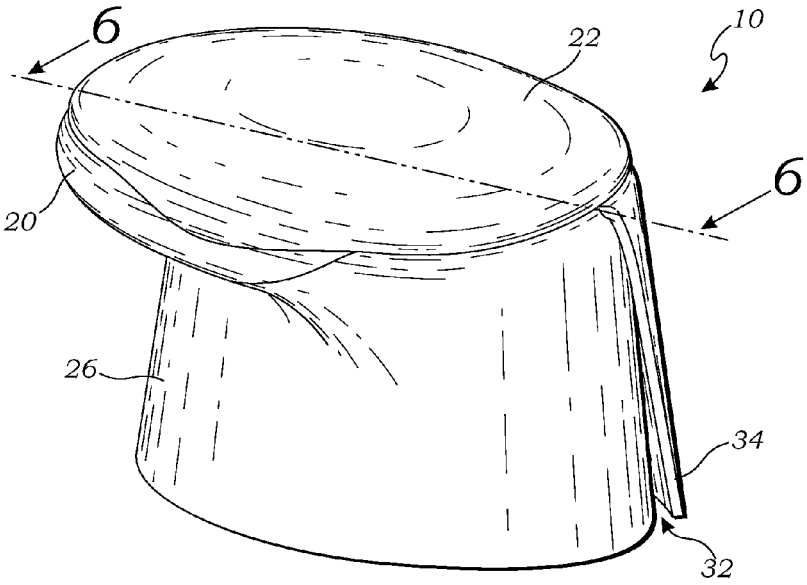
FIG. 1 is a perspective view of an exemplary embodiment of the invention.
Figure 8:
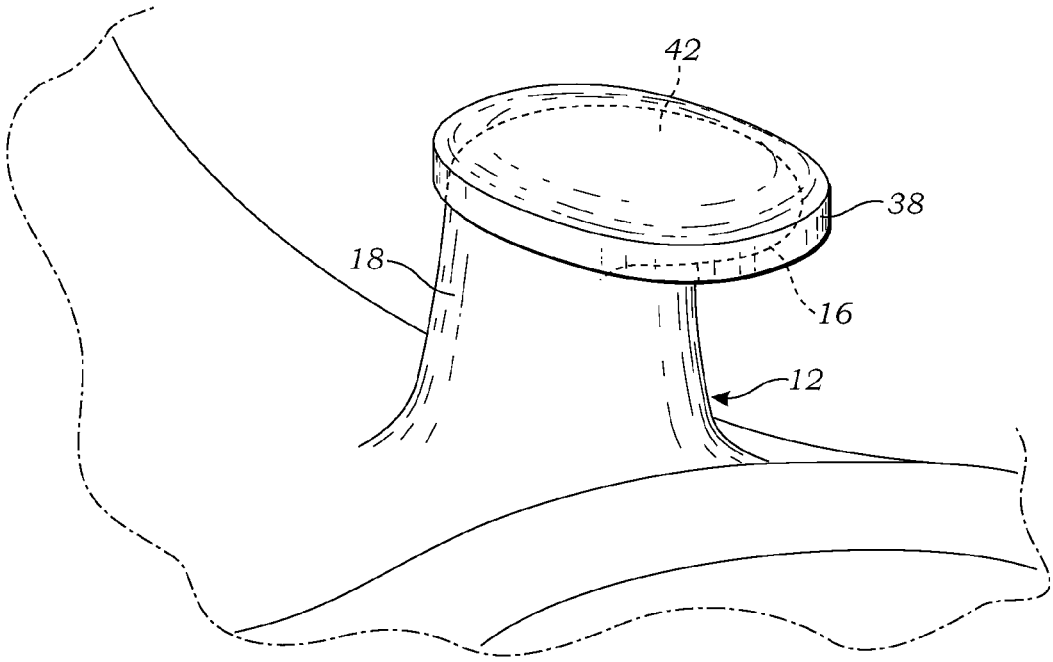
FIG. 8 is a perspective view of an alternate embodiment of the present invention as engaged on a saddle horn.

With respect to the drawings, FIG. 1 illustrates a first exemplary embodiment of a saddle horn cover apparatus 10 for providing padding over at least a portion of a saddle horn 12 (FIG. 2) while a user 14 (FIG. 2) is performing various horseback riding activities. Saddle horns are well known in the art, and typically comprise a proximal horn head 16 and a distal horn neck 18 (FIG. 8). The apparatus 10 itself comprises a cover 20 configured for removable engagement on the saddle horn 12. Preferably, the cover 20 is made of a relatively flexible material, such as leather. However, other materials, both flexible and non-flexible, as well as methods of manufacture, now known or later developed, may be substituted, including but not limited to a molded or formed rubberized material. In an alternate embodiment, the cover 20 is permanently secured to, or integral with, the saddle horn 12.

Figure 2:
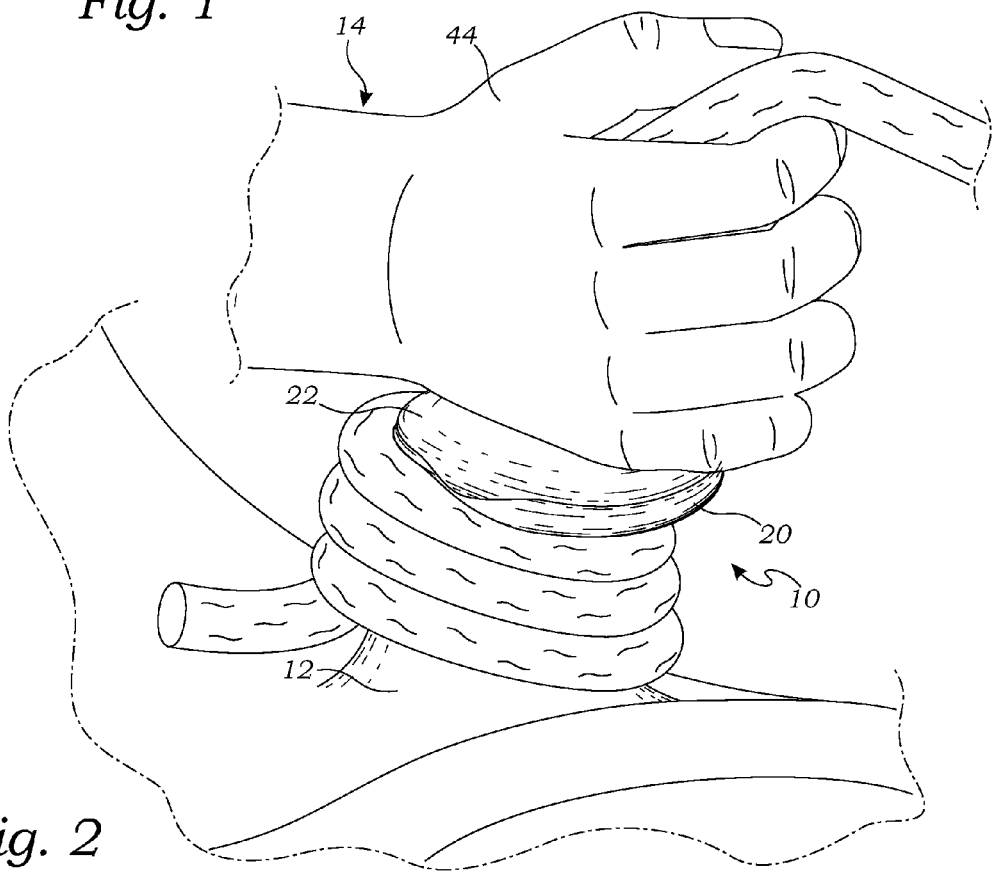
FIG. 2 is a perspective view thereof in use as engaged on a saddle horn.

A head portion 22 of the cover 20 is sized for encasing the horn head 18 when the apparatus 10 is engaged on the saddle horn 12, as shown in FIG. 2. The head portion 22 further defines a first opening 24, shown best in FIGS. 6 and 7, which is sized for allowing the horn head 16 to pass therethrough. A neck portion 26 of the cover 20 is integral with the head portion 22, preferably about a perimeter 28 of the first opening 24. The neck portion 26 extends distally from the head portion 22 and terminates in a second opening 30, also sized for allowing the horn head 16 to pass therethrough. The neck portion 26 itself is configured for encasing at least a portion of the horn neck 18 when the apparatus 10 is engaged on the saddle horn 12. The first and second openings 24 and 30 are interconnected, thereby forming a single continuous opening in the cover 20 for allowing the saddle horn 12 to be inserted therethrough.

In one embodiment, shown best in FIG. 1, the neck portion 26 provides a slit 32 extending between the first and second openings 24 and 30, thereby forming a pair of opposing flaps 34. The slit 32 functions to enlarge the diameter of the second opening 30, allowing the apparatus 10 to be more easily engaged and disengaged on the saddle horn 12. In a further embodiment, shown in FIG. 7, the flaps 34 each provide a means for selectively closing the slit 32 to cooperate in securing the apparatus 10 in place once it is engaged on the saddle horn 12. Preferably, the means for selectively closing the slit 32 is a snap 36 or similar fastening means. However, other types of fastening means now known or later developed, such as hook and loop fasteners, may be substituted.

Figure 3:
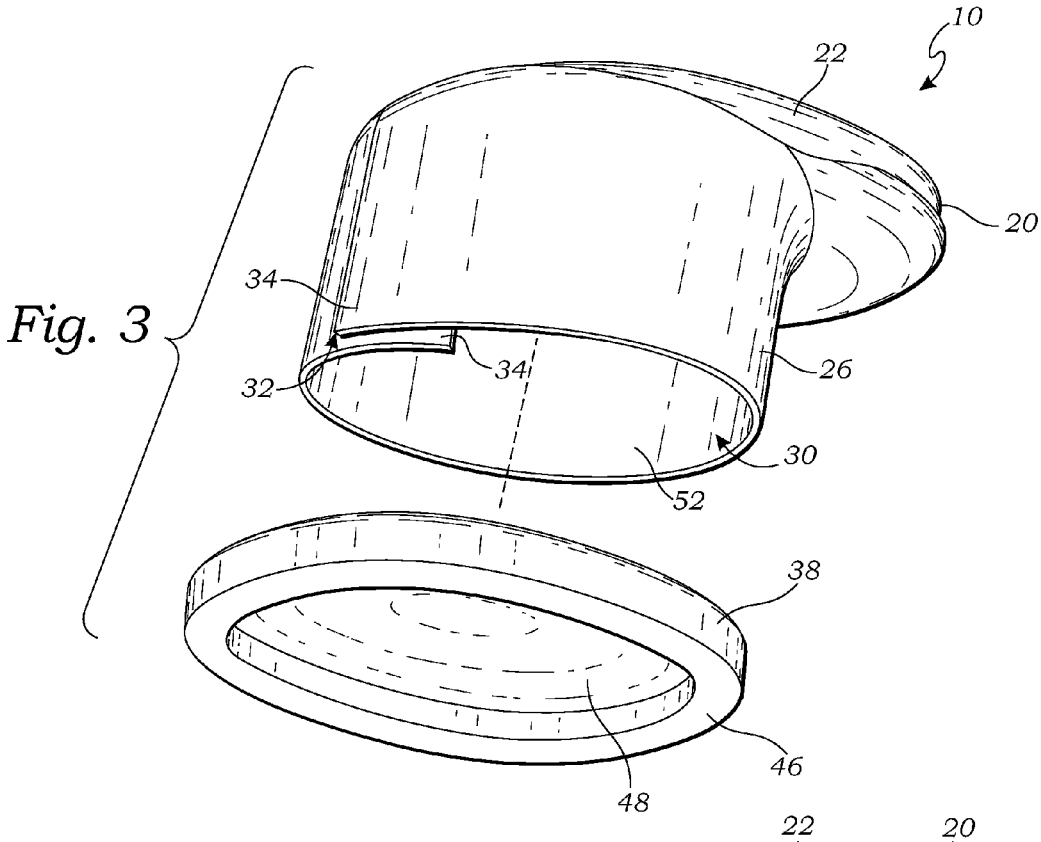
FIG. 3 is an exploded perspective view of the exemplary embodiment of the invention.
Figure 4:
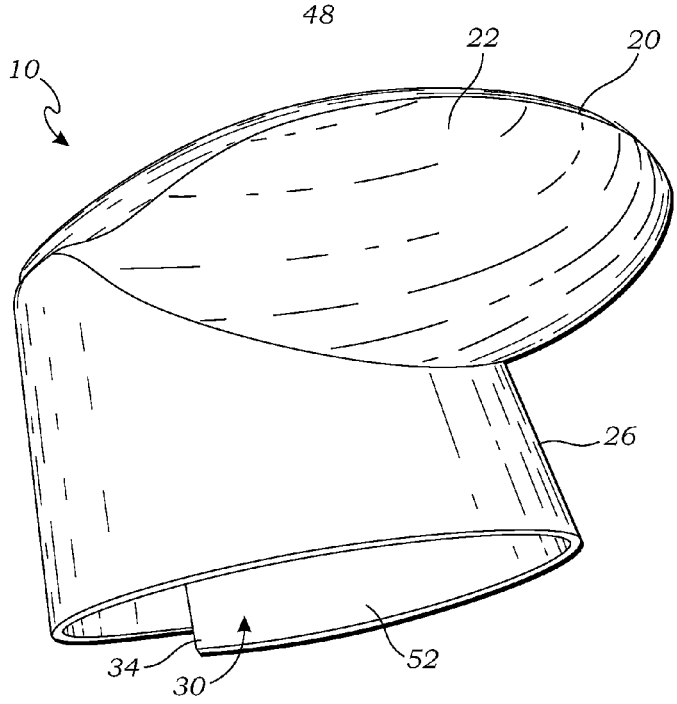
FIG. 4 is a further perspective view thereof.
Figure 5:
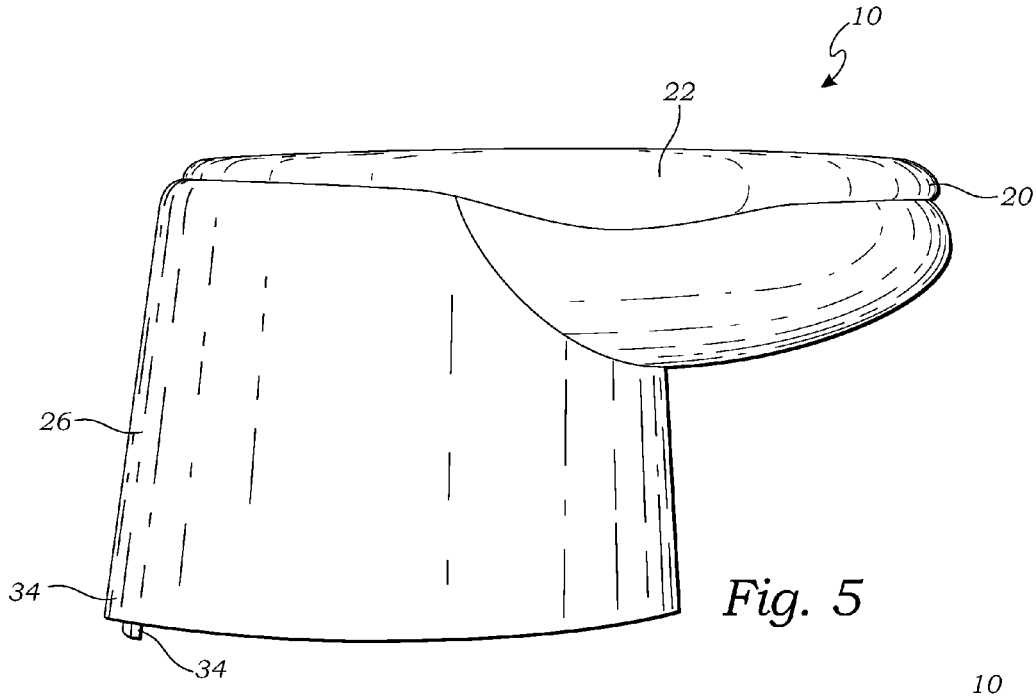
FIG. 5 is a side view thereof.
Figure 6:
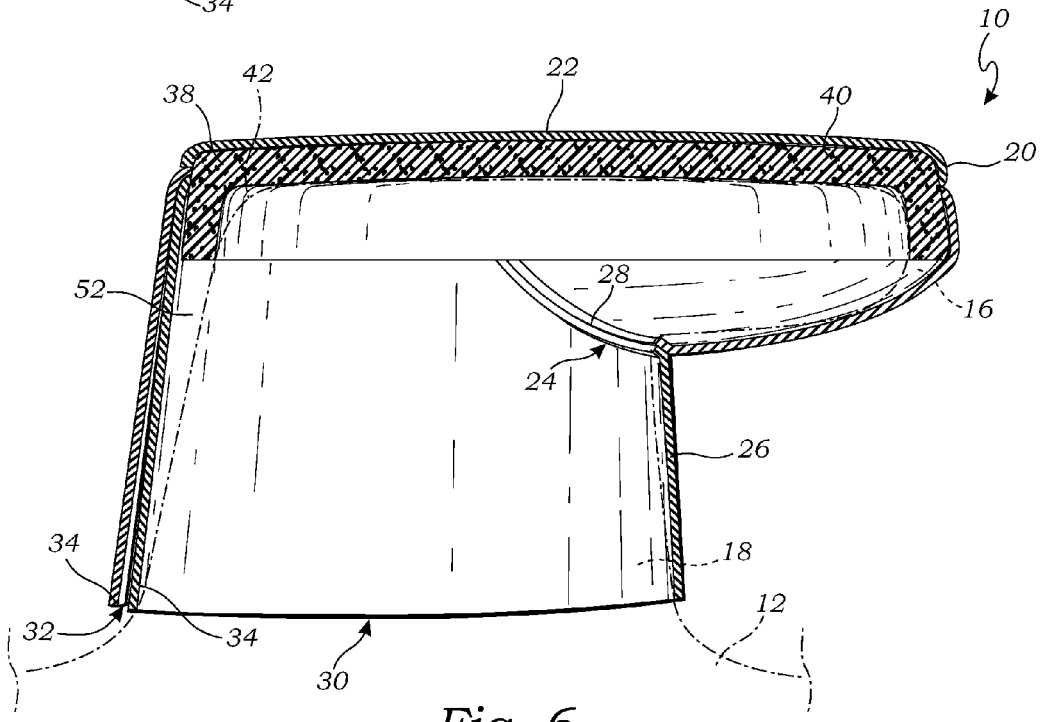
FIG. 6 is a cross-sectional view thereof as engaged on a saddle horn, taken along line 6-6 in FIG. 1.

As shown best in FIGS. 3 and 6, a soft head padding 38 is configured for being received within the head portion 22 in a position between the horn head 16 and an inner head surface 40 of the head portion 22. The head padding 38 is preferably made of a resilient material, such as foam or gel. However, other types of soft, resilient material, now known or later developed, may be substituted. In the preferred embodiment, the head padding 38 is selectively removable, thus allowing head paddings 38 of varying degrees of resiliency to be interchangeably used in the apparatus 10. In an alternate embodiment, the head padding 38 is permanently secured within the head portion 22. Preferably, when the apparatus 10 is engaged over the saddle horn 12, as shown in FIG. 6, the head padding 38 is substantially in contact with an upper surface 42 of the horn head 16. Thus, when the user 14 is performing various horseback riding activities, such as team roping, their hands 44 are protected from injury, should they strike the saddle horn 12, as illustrated in FIG. 2.

In one embodiment, as best shown in FIGS. 3 and 6, a bottom surface 46 of the head padding 38 provides a recess 48 sized and configured for receiving the upper surface 42 of the horn head 16 therein, thereby creating a more secure engagement between the apparatus 10 and the saddle horn 12 and discouraging the head padding 38 from shifting while the apparatus 10 is in use.

In an alternate embodiment, as shown in FIG. 8, the apparatus 10 merely comprises the head padding 38 without the cover 20. Thus, the head padding 38 is directly engagable on the upper surface 42 of the horn head 16 by way of stitching, adhesives, or any other permanent or non-permanent engagement means, now known or later developed, the head padding 38 in this alternative embodiment effectively functioning as both the cover and the padding.

Figure 7:
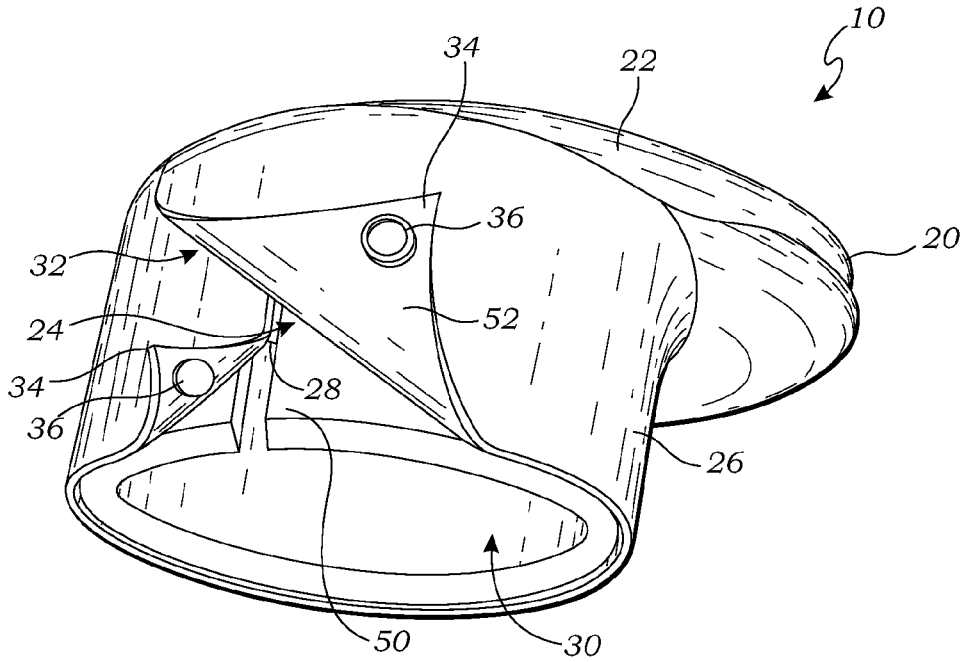
FIG. 7 is a perspective view of an alternate embodiment of the invention providing a neck padding.

In a further embodiment, as best shown in FIG. 7, a soft neck padding 50 is configured for being received within the neck portion 26 in a position between the horn neck 18 and an inner neck surface 52 of the neck portion 26. Similar to the head padding 38 described above, the neck padding 50 is preferably made of a resilient material, such as foam or gel. However, other types of soft, resilient material, now known or later developed, may be substituted. In the preferred embodiment, the neck padding 50 is selectively removable, thus allowing neck paddings 50 of varying degrees of resiliency to be interchangeably used in the apparatus 10. In an alternate embodiment, the neck padding 50 is permanently secured within the neck portion 26. Additionally, in one embodiment, the head padding 38 is integral with the neck padding 50. In another embodiment, the head padding 38 and neck padding 50 are two separate pieces.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A saddle horn cover apparatus for providing padding over at least a portion of a saddle horn, the saddle horn having a proximal horn head and a distal horn neck, the apparatus comprising:

a cover sized for engagement on the saddle horn and configured for substantially encasing at least the horn head; and a relatively soft, resilient padding configured for being received within the cover in a position between the horn head and an inner surface of the cover, a bottom surface of the padding providing a recess configured for receiving an upper surface of the horn head therewithin.

2. The saddle horn cover apparatus of claim 1, wherein the cover is removably engagable on the saddle horn.

3. The saddle horn cover apparatus of claim 1, wherein the padding is selectively removable from within the cover.

4. The saddle horn cover apparatus of claim 1, wherein the cover is made of a flexible material.

5. The saddle horn cover apparatus of claim 4, wherein the material is leather.

6. The saddle horn cover apparatus of claim 1, wherein the padding is selected from the group consisting of a resilient foam material and a resilient gel material.

7. A saddle horn cover apparatus for providing padding over at least a portion of a saddle horn, the saddle horn having a proximal horn head and a distal horn neck, the apparatus comprising:

a cover configured for removable engagement on the saddle horn, the cover comprising a head portion sized for encasing the horn head, the head portion further defining a first opening sized for allowing the horn head to pass therethrough;

a neck portion integral with the head portion about a perimeter of the first opening and extending distally therefrom, the neck portion terminating distally in a second opening sized for allowing the horn head to pass therethrough, the neck portion configured for encasing at least a portion of the horn neck, the first and second openings interconnected with one another to form a single continuous passageway into the cover for allowing the saddle horn to be inserted therewithin; and the neck portion providing a slit extending a distance between the first and second openings, forming a pair of opposing flaps, for selectively enlarging the diameter of the second opening; and a head padding configured for being received within the head portion in a position between the horn head and an inner surface of the head portion.

8. The saddle horn cover apparatus of claim 7, wherein the head padding is selectively removable from within the cover.

9. The saddle horn cover apparatus of claim 7, wherein the neck portion further comprises a means for selectively closing the slit.

10. The saddle horn cover apparatus of claim 7, wherein the neck portion further comprises a neck padding configured for being received within the neck portion in a position between the horn neck and an inner neck surface of the neck portion.

11. The saddle horn cover apparatus of claim 10, wherein the neck padding is integral with the head padding.

12. The saddle horn cover apparatus of claim 10, wherein the neck padding is selectively removable from within the cover.

13. The saddle horn cover apparatus of claim 7, wherein the cover is made of a flexible material.

14. The saddle horn cover apparatus of claim 13, wherein the material is leather.

15. The saddle horn cover apparatus of claim 10, wherein the head padding and neck padding are each selected from the group consisting of a resilient foam material and a resilient gel material.

16. The saddle horn cover apparatus of claim 7, wherein a bottom surface of the head padding provides a recess configured for receiving an upper surface of the horn head therewithin.

17. A saddle horn cover apparatus for providing padding over at least a portion of a saddle horn, the saddle horn having a proximal horn head and a distal horn neck, the apparatus comprising:

a cover sized for removable engagement on the saddle horn and configured for substantially encasing at least the horn head; and a relatively soft, resilient, substantially disc-shaped padding sized for approximating the surface area of an upper surface of the horn head and configured for being removably received within the cover, in a position between the upper surface of the horn head and an inner surface of the cover;

whereby, with the padding positioned within the cover, the apparatus substantially approximates the dimensions of the external surface area of the saddle horn, when engaged thereon, and provides a sufficient amount of padding on the horn head, to assist in protecting a user's hands during various horseback riding activities, while not unnecessarily obstructing the saddle horn itself from carrying out its intended functionality.

* * * * *